US007691214B2

(12) United States Patent
Ullman

(10) Patent No.: US 7,691,214 B2
(45) Date of Patent: Apr. 6, 2010

(54) HIGH STRENGTH ALUMINUM ALLOYS FOR AIRCRAFT WHEEL AND BRAKE COMPONENTS

(75) Inventor: John E. Ullman, Granger, IN (US)

(73) Assignee: Honeywell International, Inc., Morristown, NJ (US)

( * ) Notice: Subject to any disclaimer, the term of this patent is extended or adjusted under 35 U.S.C. 154(b) by 630 days.

(21) Appl. No.: 11/360,403

(22) Filed: Feb. 24, 2006

(65) Prior Publication Data

US 2006/0266491 A1 Nov. 30, 2006

Related U.S. Application Data

(60) Provisional application No. 60/684,529, filed on May 26, 2005.

(51) Int. Cl.
*C22C 21/10* (2006.01)

(52) U.S. Cl. ..... 148/417; 420/532; 420/538

(58) Field of Classification Search ..... 148/417; 420/532, 538

See application file for complete search history.

(56) References Cited

U.S. PATENT DOCUMENTS

| | | | |
|---|---|---|---|
| 2,090,894 | A | 8/1937 | Yonosuke |
| 3,544,394 | A | 12/1970 | Lyle, Jr. et al. |
| 3,563,814 | A | 2/1971 | Lyle, Jr. et al. |
| 3,637,441 | A | 1/1972 | Lyle, Jr. et al. |
| 4,770,848 | A | 9/1988 | Ghosh et al. |

(Continued)

FOREIGN PATENT DOCUMENTS

| | | | |
|---|---|---|---|
| CN | 1 530 455 | A | 9/2004 |

(Continued)

OTHER PUBLICATIONS

XP002465509; Database WPI Week 197435, Derwent Publications Ltd., GB; AN 1974-62615V.

*Primary Examiner*—Roy King
*Assistant Examiner*—Janelle Morillo
(74) *Attorney, Agent, or Firm*—Birch, Stewart, Kolasch & Birch, LLP

(57) ABSTRACT

An iron-containing heat-resistant aluminum-based alloy product consisting essentially of, in weight percent: up to 0.15% chromium, 0.80-1.20% copper, 0.80-1.20% iron, 2.20-2.80% magnesium, up to 0.10% manganese, 0.80-1.20% nickel, up to 0.15% silicon, up to 0.15% titanium, 5.50-7.00% zinc, up to 0.25% zirconium, and up to 0.25% scandium, with the balance being aluminum. Also, a manganese-containing heat-resistant aluminum-based alloy product consisting essentially of, in weight percent: up to 0.25% chromium, 0.80-1.20% copper, up to 0.30% iron, 2.30-2.90% magnesium, 2.70-3.10% manganese, 2.85-3.25% nickel, up to 0.15% silicon, up to 0.15% titanium, 6.10-7.10% zinc, up to 0.25% zirconium, and up to 0.25% scandium, with the balance being aluminum. A spray-formed billet of the alloy is prepared by: charging aluminum and the other elements that are to make up the alloy into a crucible; melting the elements in the crucible to form the alloy; pouring the melted alloy through an atomizer to atomize the alloy in a spray chamber; and depositing the atomized alloy onto a collector disc at the bottom of the spray chamber to form the desired spray-formed billet. The billet can then be forged into a shaped product, such as an aircraft inboard main wheel half.

2 Claims, 1 Drawing Sheet

U.S. PATENT DOCUMENTS

| | | | | |
|---|---|---|---|---|
| 4,798,237 | A | 1/1989 | Nakano | |
| 6,387,540 | B1 | 5/2002 | Yoshidomi et al. | |
| 6,610,247 | B2 | 8/2003 | Wittebrood et al. | |
| 6,695,935 | B1 | 2/2004 | Haszler et al. | |
| 6,800,244 | B2 | 10/2004 | Wittebrood et al. | |
| 2002/0079604 | A1 | 6/2002 | Davis et al. | |
| 2002/0088599 | A1 | 7/2002 | Davis et al. | |
| 2003/0183306 | A1 | 10/2003 | Hehmann et al. | |
| 2004/0089378 | A1* | 5/2004 | Senkov et al. | 148/417 |
| 2004/0109787 | A1 | 6/2004 | Haszler et al. | |

FOREIGN PATENT DOCUMENTS

| | | | |
|---|---|---|---|
| GB | 476 930 | A | 12/1937 |
| GB | 546 899 | A | 8/1942 |
| GB | 598 328 | A | 2/1948 |
| GB | 601 813 | A | 5/1948 |
| GB | 604 813 | A | 7/1948 |
| JP | 63 018034 | A | 1/1988 |
| RU | 2 215 807 | C2 | 11/2003 |
| SU | 406 931 | A | 4/1974 |

* cited by examiner

HIGH STRENGTH ALUMINUM ALLOYS FOR AIRCRAFT WHEEL AND BRAKE COMPONENTS

This non-provisional application claims priority to provisional application Ser. No. 60/684,529, which was filed on May 26, 2005. The entire contents of Ser. No. 60/684,529 is expressly incorporated by reference in the present application.

FIELD OF THE INVENTION

This invention relates to aluminum alloys for use in wheel and brake components for aircraft, automobiles, etc.

BACKGROUND OF THE INVENTION

Aluminum alloys are employed in such aircraft applications as brake piston housings, nose wheels, and both braked and non-braked main wheel halves. The aluminum alloys used in all of these applications must be strong at ambient temperatures.

Aircraft inboard main wheel halves envelop brakes that generate substantial heat. These wheel halves must be strong at somewhat elevated temperatures (e.g., up to about 150° C.), and must also possess high residual strength—that is, strength after exposure to higher temperatures (e.g., temperatures of 177° C. and higher).

SUMMARY OF THE INVENTION

Two series of aluminum alloys have been discovered that possess excellent strength at ambient temperatures. One of these alloy series ("Alloy K") also possesses excellent residual strength.

Compared to conventional aluminum alloys, the alloys of this invention are characterized by amounts of nickel and iron and/or manganese that differ significantly from the levels of these elements in conventional aluminum alloys.

This invention provides an iron-containing heat-resistant aluminum-based alloy product consisting essentially of, in weight percent: up to 0.15% chromium, 0.80-1.20% copper, 0.80-1.20% iron, 2.20-2.80% magnesium, up to 0.10% manganese, 0.80-1.20% nickel, up to 0.15% silicon, up to 0.15% titanium, 5.50-7.00% zinc, up to 0.25% zirconium, and up to 0.25% scandium, with the balance being aluminum. In these alloys, the nickel content is most preferably in the range 0.87-0.91 weight-%, the iron content is most preferably in the range 1.11-1.20 weight-%, and the manganese content is most preferably in the range 0.07-0.08 weight-%.

A particularly preferred iron-containing aluminum-based alloy in accordance with this invention consists essentially of 5.7 weight-% zinc, 2.5 weight-% magnesium, 0.1 weight-% manganese, 1 weight-% nickel, 0.15 weight-% zirconium, 1 weight-% iron, 0.1 weight-% silicon (maximum), 0.13 weight-% chromium, 1 weight-% copper, and 0.1 weight-% titanium, with the balance of the alloy being constituted of aluminum.

This invention also provides a manganese-containing heat-resistant aluminum-based alloy product consisting essentially of, in weight percent: up to 0.25% chromium, 0.80-1.20% copper, up to 0.30% iron, 2.30-2.90% magnesium, 2.70-3.10% manganese, 2.85-3.25% nickel, up to 0.15% silicon, up to 0.15% titanium, 6.10-7.10% zinc, up to 0.25% zirconium, and up to 0.25% scandium, with the balance being aluminum. In these manganese-containing aluminum alloys, the nickel content is most preferably in the range 3.02-3.22 weight-%, the iron content is most preferably in the range 0.08-0.30 weight-%, and the manganese content is most preferably in the range 2.81-2.91 weight-%.

A particularly preferred manganese-containing aluminum-based alloy in accordance with this invention consists essentially of 6.5 weight-% zinc, 2.5 weight-% magnesium, 3 weight-% manganese, 3 weight-% nickel, 0.15 weight-% scandium, 0.15 weight-% zirconium, 0.1 weight-% iron (maximum), 0.1 weight-% silicon (maximum), 0.25 weight-% chromium, 1 weight-% copper, and 0.1 weight-% titanium, with the balance of the alloy being constituted of aluminum.

Another embodiment of the present invention is a process for producing a spray-formed billet. This process involves: charging aluminum and the other elements that are to make up the alloy into a crucible; melting the elements in the crucible to form the alloy; pouring the melted alloy through an atomizer to atomize the alloy in a spray chamber; and depositing the atomized alloy onto a collector disc at the bottom of the spray chamber to form the desired spray-formed billet. The billet can then be forged into a shaped product, such as an aircraft inboard main wheel half.

DETAILED DESCRIPTION OF THE INVENTION

Figure 1:
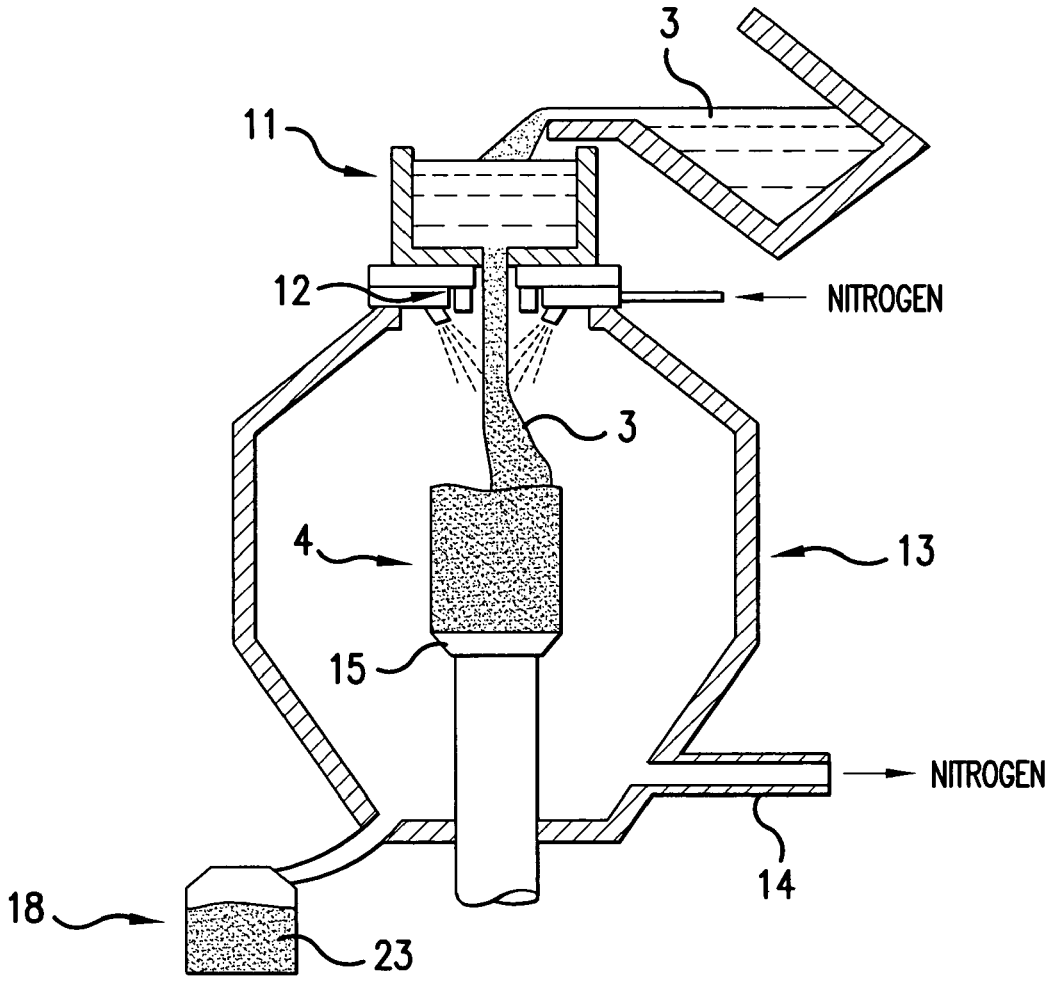
FIG. 1 is a schematic cross-sectional view of a spray forming operation in accordance with one aspect of the present invention.

An iron-containing alloy of this invention is sometimes referred to herein as "Alloy A". A manganese-containing alloy of this invention is sometimes referred to herein as "Alloy K". The following tables show the weight percentages of various elements added to aluminum to make specific embodiments of the alloys of the present invention.

Alloy A Chemistry

| | 504 | 562 | 563 | 564 | 569 | 571 | 572 |
|---|---|---|---|---|---|---|---|
| Cr | 0.13 | 0.12 | 0.13 | 0.12 | 0.12 | 0.13 | 0.12 |
| Cu | 0.99 | 0.96 | 1.05 | 0.98 | 1.03 | 1.03 | 1.00 |
| Fe | 1.07 | 1.16 | 1.11 | 1.18 | 1.20 | 1.19 | 1.18 |
| Mg | 2.46 | 2.42 | 2.54 | 2.31 | 2.39 | 2.37 | 2.46 |
| Mn | 0.07 | 0.08 | 0.08 | 0.08 | 0.07 | 0.08 | 0.07 |
| Ni | 0.87 | 0.87 | 0.88 | 0.88 | 0.90 | 0.88 | 0.91 |
| Sc | — | — | — | — | — | — | — |
| Si | 0.12 | 0.08 | 0.10 | 0.10 | 0.08 | 0.07 | 0.09 |
| Ti | 0.07 | 0.06 | 0.06 | 0.07 | 0.07 | 0.07 | 0.08 |
| Zn | 5.72 | 5.65 | 5.98 | 5.58 | 6.17 | 6.10 | 5.77 |
| Zr | 0.02 | 0.08 | 0.03 | 0.02 | 0.11 | 0.10 | 0.11 |
| Al | balance | balance | balance | balance | balance | balance | balance |

Alloy K Chemistry

| | 557 | 558 | 559 | 560 | 567 | 570 |
|---|---|---|---|---|---|---|
| Cr | 0.18 | 0.23 | 0.25 | 0.22 | 0.23 | 0.18 |
| Cu | 0.94 | 1.04 | 1.06 | 1.06 | 1.08 | 1.06 |
| Fe | 0.08 | 0.23 | 0.30 | 0.22 | 0.22 | 0.25 |
| Mg | 2.60 | 2.51 | 2.46 | 2.68 | 2.45 | 2.47 |

-continued

| | 557 | 558 | 559 | 560 | 567 | 570 |
|---|---|---|---|---|---|---|
| Mn | 2.81 | 2.83 | 2.88 | 2.90 | 2.91 | 2.88 |
| Ni | 3.04 | 3.03 | 3.06 | 3.02 | 3.06 | 3.22 |
| Sc | 0.19 | 0.10 | 0.10 | 0.09 | 0.11 | 0.09 |
| Si | 0.05 | 0.11 | 0.09 | 0.08 | 0.16 | 0.07 |
| Ti | 0.10 | 0.13 | 0.11 | 0.10 | 0.12 | 0.12 |
| Zn | 6.58 | 6.46 | 6.47 | 6.50 | 6.25 | 6.51 |
| Zr | 0.09 | 0.11 | 0.11 | 0.10 | 0.05 | 0.11 |
| Al | balance | balance | balance | balance | balance | balance |

EXAMPLES

Persons skilled in the art will appreciate that when alloy compositions are stated, single weight percent values for each element are considered nominal values unless identified as minimum or maximum values.

Specific Alloys

| Element | Composition, weight percent | |
|---|---|---|
| | Alloy A | Alloy K |
| Zn | 5.70 | 6.50 |
| Mg | 2.50 | 2.50 |
| Mn | 0.10 | 3.00 |
| Ni | 1.00 | 3.00 |
| Sc | — | 0.15 |
| Zr | 0.15 | 0.15 |
| Fe | 1.00 | 0.10* |
| Si | 0.10* | 0.10* |
| Cr | 0.10* | 0.18 |
| Cu | 1.00 | 1.00 |
| Ti | 0.10 | 0.10 |
| Al | balance | balance |

*maximum

The end-use products of this invention may be produced by forging spray-formed billets of the alloys. Spray forming is a process involving melt atomization and collection of the spray droplets onto a substrate to produce a near fully dense preform. Processing rates up to about 2 kg/s are employed. An apparatus that may be used for spray forming is illustrated in FIG. 1. In the spray forming process, the ingredients are blended and melted in a melting furnace. Then the aluminum-based blend of molten metal 3 is decanted into a tundish 11 that is equipped at its bottom with a twin atomizer system 12 which is driven by inert gas (for instance, nitrogen). The twin atomizer system is located within a spray chamber 13, at the top thereof. At the bottom of the spray chamber is a collector disc 15 upon which a billet is formed. The twin atomizer 12 atomizes the aluminum-based alloy blend 3. The atomized aluminum-based alloy blend then settles onto the collector disc to form the desired spray-formed billet 4 of solidified aluminum-based alloy blend. Also at the bottom of the spray chamber 13 is an overspray collection chamber 18 which collects the sprayed metal 23 (cooled to powder form) that "misses" the collector disc. Also at the bottom of the spray chamber is an exhaust port 14 for the atomization gas.

In a typical melt cycle, a crucible is filled with metal in accordance with the formulations described hereinabove, except for the zinc component. The charged crucible is heated to 940° C.; the melted metal is thus maintained at a temperature of approximately 850° C. After 15 minutes at 940° C., even the Fe has gone into solution. The temperature of the crucible is then reduced to 850° C. and the zinc is added. The zinc is completely dissolved after 10 minutes at this temperature. The temperature is then reduced to the pour temperature, and the molten alloy is sprayed in accordance with the above-described procedure. Various typical parameters are given in the tables that follow:

Alloy A Parameters

| | 504 | 562 | 563 | 564 | 569 | 571 | 572 |
|---|---|---|---|---|---|---|---|
| Charge weight (lbs) | 35.44 | 109.98 | 109.96 | 109.94 | 107.06 | 106.80 | 110.02 |
| Pour temp (° C.) | 785 | 790 | 791 | 816 | 822 | 821 | 822 |
| Flow rate (kg/min) | 5.33 | 6.37 | 5.76 | 6.22 | 6.43 | 6.62 | 6.59 |
| Billet weight (lbs) | 21.56 | 70.70 | 38.96 | 67.30 | 65.55 | 63.10 | 66.30 |

Alloy K Parameters

| | 557 | 558 | 559 | 560 | 567 | 570 |
|---|---|---|---|---|---|---|
| Charge weight (lbs) | 35.00 | 110.04 | 110.00 | 110.04 | 110.02 | 110.03 |
| Pour temp (° C.) | 790 | 790 | 790 | 790 | 804 | 802 |
| Flow rate (kg/min) | 5.90 | 6.25 | 6.69 | 6.77 | 6.66 | 6.50 |
| Billet weight (lbs) | 20.48 | 74.55 | 75.85 | 74.70 | 64.25 | 65.05 |

Due to rapid solidification of the droplets, microstructural improvements in the spray forming of aluminum alloys in accordance with this invention provide no macro-segregation, reduced micro-segregation, fine intermetallic constituents, small equiaxed grains, and/or extended solid solubility.

What is claimed is:

1. A manganese-containing heat-resistant aluminum-based alloy product consisting essentially of, in weight percent:

| | |
|---|---|
| Cr | 0.00-0.15 |
| Cu | 0.80-1.20 |
| Fe | 0.80-1.20 |
| Mg | 2.20-2.80 |
| Mn | 0.00-0.10 |
| Ni | 0.80-1.20 |
| Si | 0.00-0.15 |
| Ti | 0.00-0.15 |
| Zn | 5.50-7.00 |

-continued

| | |
|---|---|
| Zr | 0.00-0.25 |
| Sc | 0.00-0.25 |

balance aluminum.

2. A manganese-containing aluminum-based alloy product consisting essentially of, in weight percent: 6.5 weight-% zinc, 2.5 weight-% magnesium, 3 weight-% manganese, 3 weight-% nickel, 0.15 weight-% scandium, 0.15 weight-% zirconium, 0.1 weight-% iron (maximum), 0.1 weight-% silicon (maximum), 0.25 weight-% chromium, 1 weight-% copper, and 0.1 weight-% titanium, with the balance of the alloy being aluminum.

* * * * *

UNITED STATES PATENT AND TRADEMARK OFFICE

CERTIFICATE OF CORRECTION

PATENT NO. : 7,691,214 B2
APPLICATION NO. : 11/360403
DATED : April 6, 2010
INVENTOR(S) : John E. Ullman It is certified that error appears in the above-identified patent and that said Letters Patent is hereby corrected as shown below:

Delete the table in claim 1, starting at column 4, line 60 and replace with the following:

| | |
|---|---|
| Cr | 0.18-0.25 |
| Cu | 0.94-1.08 |
| Fe | 0.08-0.30 |
| Mg | 2.45-2.68 |
| Mn | 2.81-2.91 |
| Ni | 3.02-3.22 |
| Si | 0.05-0.16 |
| Ti | 0.10-0.13 |
| Zn | 6.25-6.58 |
| Zr | 0.05-0.11 |
| Sc | 0.09-0.19 |

Signed and Sealed this
Twenty-eighth Day of June, 2011

David J. Kappos

David J. Kappos
*Director of the United States Patent and Trademark Office*